United States Patent [19]

Kortepeter

[11] 4,259,142

[45] Mar. 31, 1981

[54] MACHINE FOR APPLYING ROOFING MATERIAL

[76] Inventor: Dale T. Kortepeter, 2411 Flintwood, Rowland Heights, Calif. 91789

[21] Appl. No.: 87,076

[22] Filed: Oct. 22, 1979

[51] Int. Cl.[3] ..... B32B 31/26; B65H 69/08

[52] U.S. Cl. ..... 156/497; 156/82; 156/157; 156/499; 156/574; 156/578; 156/579

[58] Field of Search ..... 156/304, 497, 499, 502, 156/507, 544, 545, 546, 547, 548, 574, 575, 576, 577, 578, 579, 157, 82

[56] References Cited

U.S. PATENT DOCUMENTS

| | | | |
|---|---|---|---|
| 2,084,625 | 6/1937 | Stebbins et al. | 156/499 |
| 2,664,938 | 1/1954 | Torr | 156/578 |
| 3,097,986 | 7/1963 | Kauer | 156/497 |
| 3,099,582 | 7/1963 | Onystad et al. | 156/578 |
| 4,087,309 | 5/1978 | Lang | 156/497 |

*Primary Examiner*—Caleb Weston

*Attorney, Agent, or Firm*—John G. Mesaros

[57] ABSTRACT

A machine for sealing together adjacent overlying edges of sheets of roofing material having facing bitumen compositions, the machine having a leading shoe for separating the overlying edges, heating jets or burners directed into the opening for softening the facing layers of bitumen material, a trailing guide shoe for guiding the upper sheet into contact with the lower sheet, a second set of heating jets or burners for heating the so joined edge and an adjacent roller for pressing the sheets together while providing uniform flow of the plastic heated bitumen.

9 Claims, 6 Drawing Figures

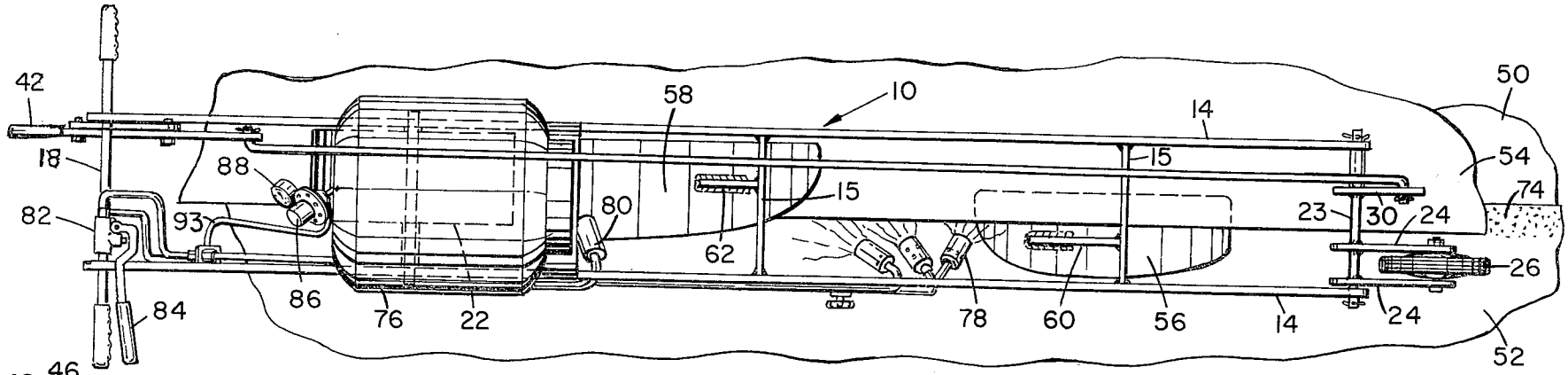
FIG. 2
FIG. 3
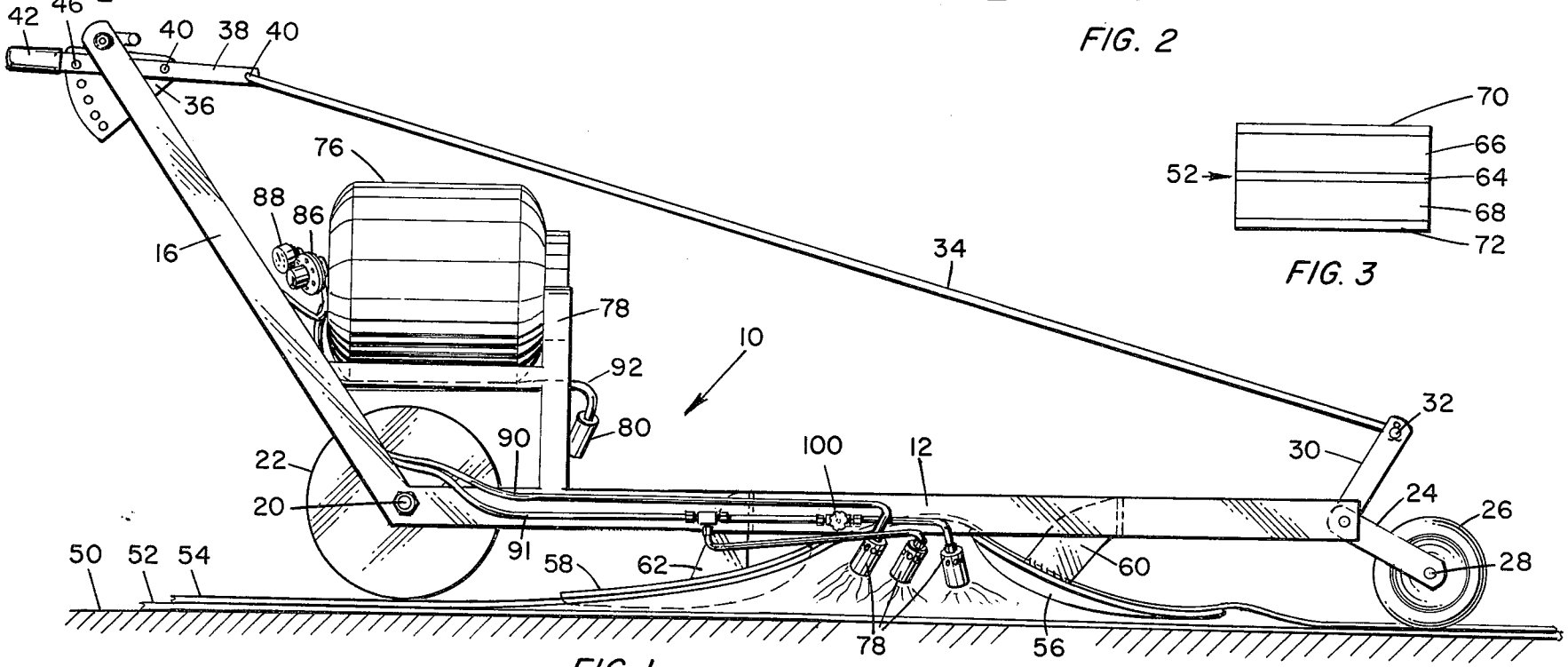
FIG. 1

MACHINE FOR APPLYING ROOFING MATERIAL

BACKGROUND OF THE INVENTION

The background of the invention will be discussed in two parts:

1. Field of the Invention

This invention relates to machines for applying roofing material, and more particularly to a machine for joining together adjacent overlying edges of roll roofing material where the facing edges are composed in part of a bitumen material.

2. Description of the Prior Art

Roofing material has generally been composed of a tar or pitch-like material, with such roofing material being commercially available in rolls. Such materials are usually applied to a roofing substrate such as plywood or the like by rolling out one strip or sheet of material with a second strip being rolled out thereafter with the edges overlapping. Normally, prior to the rolling out of the roofing material, a liquid or molten tar-like material is applied to the substrate or roof, the roofing material is suitably positioned on this liquid or molten tar to provide adhesion to the roof with subsequent strips or sheets of material having the overlapping edges suitably sealed by a liquid or molten tar interposed between facing edges. The upper edge surface is then pressed toward the lower edge to seal the joint.

New roofing materials have been developed which are particularly suitable for gently sloping or flat roofs more commonly found in industrial or commercial buildings. One such roofing material is manufactured by Koppers Company, Inc. of Pittsburgh, Pennsylvania under the trademark "KMM", and is referred to as the KMM membrane roofing material. Two such roofing materials are available, both of these materials being five-layer laminates. The standard material is provided with a polyethylene outer surface with a layer of bitumen, a plastic core, a second layer of bitumen, and an opposing outer layer of polyethylene. The second material available under the "KMM" mark is likewise a laminate composed of a thick, flexible plastic core which is protected on each side with a layer of modified bitumen with the top surface being a heavy embossed aluminum foil, and the bottom surface being a film of polyethylene. This material supplied in roll form with a four inch edge on the upper surface being polyethylene. That is, the upper surface of aluminum foil terminates four inches before the edge with this four inches having the polyethylene membrane, this edge being adapted for adhesion to a four inch portion of the under surface of an adjacent edge upon application of heat and pressure.

Conventional methods for applying this roofing material involved the use of three, four or five men. The first step in the operation is to roll out the first strip of material. A second strip of material is then rolled out in overlying overlapping relationship consistent with the four inch polyethylene upper surface thereby preliminarily forming an edge of four inches in width with facing polyethylene surfaces. A worker then comes along and bends back four inches (or more) of the upper sheet or strip to expose the upper and lower polyethylene surface. Another worker trails behind the first worker with a propane torch to heat the upper and lower edge portions. This method is referred to as a "heat fusion" method. The application of the heat by direct flame breaks and draws apart the external plastic or polyehylene film and melts the bitumen until it is plastic enough to flow under pressure. The second worker is normally working on his hands and knees and after observing proper breakdown of the polyethylene film and proper melting of the bitumen, he then manually pushes the upper sheet into overlapping relation with the lower sheet to provide a measure of adhesion. A third worker trails behind the second worker with a propane torch to reheat the surface along the edge with a fourth worker trailing behind with a heavy weighted roller which is rolled back and forth to apply pressure to the edge.

With such a manual process, many problems result. If the second worker is applying too little heat, the polyethylene film is not breaking down properly and the bitumen is not at the proper plastic state for optimum adhesion. If he is applying too much heat, the bitumen becomes liquid rather than plastic resulting in improper adhesion as well as an unsightly flow of the bitumen out of the overlapping edge area. Likewise, if the third worker is reheating the aluminum surface at the edge improperly, the same less than optimum result is achieved. Furthermore, with the bitumen in a liquid state, the roller gathers the molten bitumen thereby requiring cleaning frequently with needless down time. Other problems can arise if the workers are not operating as a team or if the work is interrupted for any reason. Generally, an unskilled work crew using this manual method will result in unsightly edges where the bitumen material has flowed irregularly out from the overlapping region and even worse, improper adhesion resulting from lack of uniformity or consistency in the heating and rolling process results in voids and uneven distribution of the bitumen within the overlapping region. In such cases, the edges can be readily separated where improper heat and pressure has been applied. The rolling operation often times results in a gathering or puckering of the upper layer of material thus further adding to the unsightliness as well as the imperfection of the bond.

Furthermore, since roofing material is applied on the exterior of the building ambient conditions produce variables of temperature and humidity which affect the amount of heat to be applied, the timing of the application of heat and pressure as well as other factors.

It is an object of this invention to provide a new and improved machine for joining adjacent strips of roofing material together in overlapping relation.

It is another object of this invention to provide a new and improved machine for applying adjacent sheets of a roofing material together in an overlapping relation to provide a uniform bond between the adjacent surfaces of the overlapping edges.

SUMMARY OF THE INVENTION

The foregoing and other objects of the invention are accomplished by providing a machine which includes a main frame adapted to be pushed over a roof. The main frame includes a roller rotatably mounted thereto adjacent the rear end thereof and a guide wheel at the front end thereof. Interposed therebetween is a leading guide shoe adjacent the front wheel for lifting an overlapping edge of roofing material a predetermined amount with means for applying heat at a predetermined position between the upper and lower sheets of roofing material adjacent thereto. A trailing shoe mounted to the frame guides the heated sheets or strips of roofing material together with the roller being positioned to apply a selected pressure to the upper sheet to promote uniform flow of the plastic bitumen material. In a particular embodiment of the invention, means are provided for adjusting the amount of heat applied in the overlapping area of the facing surfaces of roofing material with a second means being provided for heating the trailing shoe and roller, this latter heating means being selectively employed dependig on ambient conditions. In the embodiment illustrated, the heating means employed are gas operated burners.

Other objects, features, and advantages of the invention will become apparent from a reading of the specification when taken in conjunction with the drawings in which like reference numerals refer to like elements in the several views.

BRIEF DESCRIPTION OF THE DRAWINGS

FIG. 1 is a side view of a machine for applying roofing material in accordance with the invention;

FIG. 2 is a top view of the machine shown in FIG. 1;

FIG. 3 is an exaggerated cross-sectional view of a roofing material particularly suited for use with the machine of FIG. 1;

DESCRIPTION OF THE PREFERRED EMBODIMENT

Figure 4:
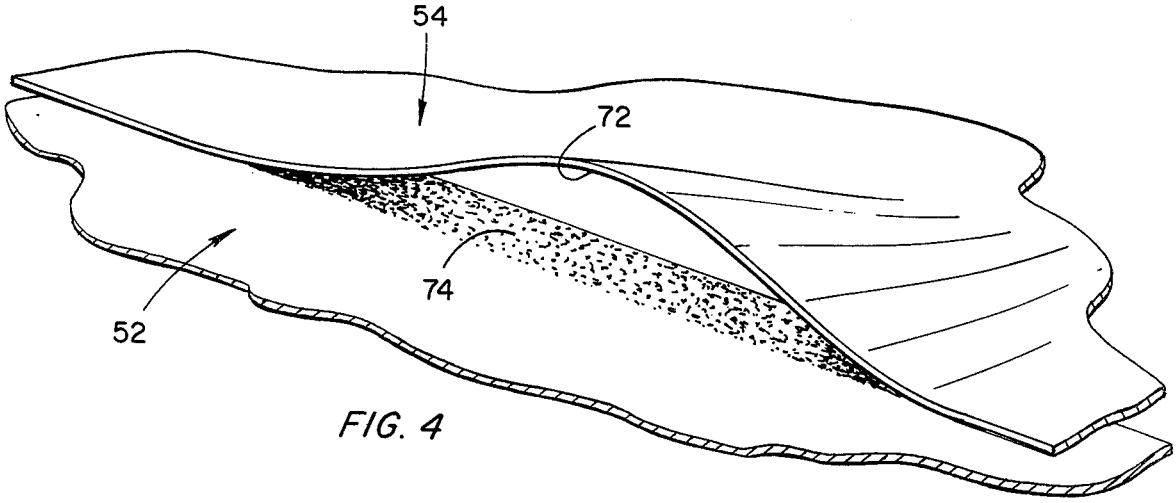
FIG. 4 is a perspective view of two adjoining sheets of roofing material such as those for which the machine of the present invention is utilized.

Referring now to the drawings, and more particularly to FIGS. 1 and 2, there is shown a roofing machine generally designated 10, in accordance with the invention. The machine 10 includes a main frame 12 comprising a pair of generally parallel side rails 14, cross support members 15 interconnecting the side rails 14 and a pair of generally parallel upwardly extending side arms 16. Interconnecting the side arm 16 adjacent the upper free ends thereof is a handle member 18 which may be generally rod-shaped with the outer ends thereof extending beyond opposing outer surfaces of the arms 16 for gripping by an operator and appropriate use as will be hereinafter described.

The lower portion of frame 12 is generally rectangular in form with the rear end thereof having an axle 20 extending therethrough for rotatably receiving thereon a roller member 22. The front end of the frame 12 has extending therethrough a pivotable rod 23. The rod 23 has welded or suitably affixed thereto adjacent one end thereof a pair of parallel bar-shaped arms 24 with the spacing therebetween sufficient for receiving a height adjusting wheel 26 which is rotatably mounted to the ends of arms 24 by means of an axle 28 in a conventional manner. Upwardly extending from the rod 23 at an angle to the arms 24 is a crank arm 30, the upper free end of which is provided with an aperture extending therethrough for pivotally receiving the bent end 32 of a connecting rod 34, the opposite end of which extends into proximity with the handle 18.

One side arm 16 has secured thereto a sector-shaped member 36 in proximity to the handle 18. An adjusting arm 38 is pivotally secured by means of pivot 40 to the apex of the sector-shaped member 36 with the arm 38 having an aperture in one end thereof for receiving a bent end 40 of the connecting rod 34. The other end of the adjusting arm 38 is provided with a handle grip 42 for enabling height adjustment of the wheel 26 in response to pivoting of the adjusting arm 38 by the operator. Facing portions of the sector-shaped member 36 and the adjusting arm 38 are provided with suitable means of frictional engagement for securing the adjusting arm 38 in a selected position. The particular means employed includes apertures 44 extending through the arc of the member 36 with an aligned pin 46 extending through the adjusting arm 38 for suitably locking the arm 38 relative to the sector-shaped member 36 for selectively positioning the wheel 26. With this configuration, the lower edge of frame 12 may be maintained a given height above the roof 50 as layers of roofing material 52 and 54 are being bonded in overlapping relation (see FIG. 1).

With the frame 12 supported at the front end by means of the height adjusting wheel 26 and at the rear end by means of roller member 22, the frame 12 can be moved by an operator gripping the handles 18 for rolling engagement with the roof 50. As best illustrated in FIG. 2, the height adjusting wheel 26 is offset to one side to roll on the lower sheet of roofing material 52 adjacent the edge of the upper sheet of roofing material 54. Disposed intermediate the wheel 26 and roller member 22 are first and second guide shoes 56 and 58. Guide shoe 56 is the lead or underlying guide shoe and is a contoured surface extending rearwardly and upwardly from a position in proximity to the roof 50 or roofing material 52. The guide shoe 56 is suitably secured to the frame 12 such as by means of an arm or fixture 60 secured to the upper surface of shoe 56 such as by means of welding in generally perpendicular relation thereto, with the other end of fixture 60 being suitably secured or welded to cross member 15. Similarly, the trailing or second guide shoe 58 is a contoured surface extending downwardly from a position in proximity to frame 12 and rearwardly toward the surface of roof 50 so that the trailing edge thereof is in proximity to and spaced from the surface of the roofing material to be applied. The trailing edge of trailing guide shoe 58 terminates in spaced proximity to the roller member 22. The second guide shoe 58 is likewise suitably secured to a second cross support member 15 of frame 12 by a second fixture 62 generally perpendicular to the upper surface of guide shoe 58 and affixed such as by welding to the shoe 58 and cross support member 15. As better illustrated in FIG. 2, the leading guide shoe 56 is positioned on frame 12 adjacent the side rail 14 closer to the wheel 26 (that is the right-hand side of the machine 10 as viewed from the operator position) with the trailing shoe 58 being positioned closer to the opposite side rail 14 (the left-hand side of the machine 10). With this particular physical arrangement, the machine is configured for movement in one direction and may be referred to as a right-hand arrangement. That is, the height adjusting wheel 26 is aligned adjacent the right-hand end of frame 12 with the lead guide shoe 56 adjacent the right-hand edge of the frame 12. A left-hand machine can likewise be made by constructing the machine 10 with the height adjusting wheel 26 and lead guide shoe 56 adjacent the left-hand side of frame 12 with the trailing guide shoe 58 positioned adjacent the right-hand side of the frame 12.

As can be seen in FIG. 2, the dimension and contour of guide shoes 56 and 58 is such that with the height adjusting wheel 26 adjacent the edge of the upper roofing material 54 and guided by the operator parallel thereto, the underlying or lead guide shoe 56 has a part of the length thereof under the upper sheet of roofing material 54 with the contoured configuration thereof gently and gradually elevating the upper layer or sheet of roofing material 54 for providing spacing between the adjacent facing areas of the overlapping edge region of the two layers of roofing material 52 and 54.

The trailing or overlying guide shoe 58 is contoured and gently sloping downwardly and rearwardly for positioning on the upper surface of the upper layer of roofing material 54 for guiding the roofing material downwardly into abutting relation with the lower sheet of roofing material 52 as the machine 10 is moved relative to the roofing surface 50.

Referring briefly to FIG. 3, one roofing material particularly suited for use with the machine 10 has a cross-section thereof illustrated. In FIG. 3, the roofing material generally designated 52 (it being understood that the roofing material 54 would be the same material) is a five-layer laminate composed of a thick, flexible plastic core 64 having bonded on either side thereof a layer of modified bitumen 66 and 68 with the top surface being a heavy embossed aluminum foil layer 70 and the bottom surface 72 being a film of polyethylene. As previously discussed, such a material is sold by the Koppers Company as "KMM Membrane" roofing material. This particular material is sold in rolls wherein the upper layer 70 has the aluminum foil terminating approximately four inches from one edge with this four inch surface having a polyethylene film in lieu of the aluminum foil. This polyethylene film is generally of the same substance and same thickness as the polyethylene film bottom layer 72 of the roofing material 52. With the upper and lower strips of roofing material 54 and 52 respectively in overlapping edge relation as shown in FIGS. 1, 2 and 4 the four inch edge 74 (the polyethylene edge) of the lower strip of roofing material 52 has four inches of the bottom polyethylene surface 72 of the upper strip of roofing material 54 in overlapping relationship therewith. The particular polyethylene film of the edge 74 and the bottom surface 72 of the upper layer of roofing material 54, upon the application of heat, breaks and draws apart to expose the bitumen layer 66 of the lower sheet of roofing material 52 and the facing bitumen layer 68 of the upper sheet of roofing material 54. Upon further proper application of a flame or heat, the facing overlapping bitumen areas become plastic and upon application of pressure the plasticized bitumen flows to provide adhesion of the upper strip of roofing material 54 to the lower strip of roofing material 52 in the overlapping edge region. Ideally, the heat and pressure will be so selected that there are no voids or gaps in the overlapping region for providing a secure bond. However, in actual practice, ambient or environmental conditions as well as the skill of the workers manually performing the process drastically affect the results.

Referring now again to FIGS. 1 and 2, the machine 10 is provided with a heating system which includes a fuel tank 76 suitably mounted on the frame 12 such as by means of a support stand 78 which may be formed of bar-shaped material suitably affixed such as by welding to the frame 12 for supporting the tank 76 adjacent the rear of frame 12 and immediately above and slightly forwardly of roller member 22. The tank 76 may contain liquified petroleum gas, propane gas or butane for example as a fuel source. The heating system, in addition, includes a first set of heating jets or burners 78, a second set of heating jets or burners 80 and a main control valve 82 mounted on handle 18 and operable by control lever 84 manually by the operator using the machine. As illustrated in FIG. 2, the control lever 84 is in proximity to the right hand end of handle 18 for pivoting by the hand of the operator to thereby operate the main control valve 82. The tank 76, may be provided with a pressure regulator 86 and a pressure gauge 88 as is conventional with such gas systems. The control valve 82, the tank 76 and the first and second sets of burners 78 and 80 are suitably interconnected by tubing 90–93. While the preceding description referred to sets of heating jets or burners, it is to be understood that only one burner 78 and one burner 80 may be used in accordance with the invention, depending on the configuration of the nozzle for providing the heat distribution required.

As illustrated in FIG. 1, the first set of heating jets or burners 78 are suitably mounted on the frame 12 on the right hand side rail 14 with the nozzles being directed downwardly and inwardly relative to the frame 12 for applying flame or heat to the facing polyethylene film layers in the overlapping edge region of the strips of roofing material 52 and 54 for breaking up the film and heating the exposed bitumen layers into a plastic state. As illustrated in FIG. 1, the positioning of the first set of burners 78 is slightly rearwardly of the leading guide shoe 56 and forwardly of the trailing guide shoe 58, that is, intermediate the first and second guide shoes. The second set of heating jets or burners 80 (only one being shown) is directed downwardly and rearwardly and is positioned generally above the trailing edge of the trailing guide shoe 58. The use of this burner 80 is optional during operation of the machine 10 as will hereinafter be described. However, it is to be noted, that in use the burner 80 applies heat to the guide shoe 58 as well as the roller member 22 and the adjacent surface of the upper layer of roofing material 54.

Figure 6:
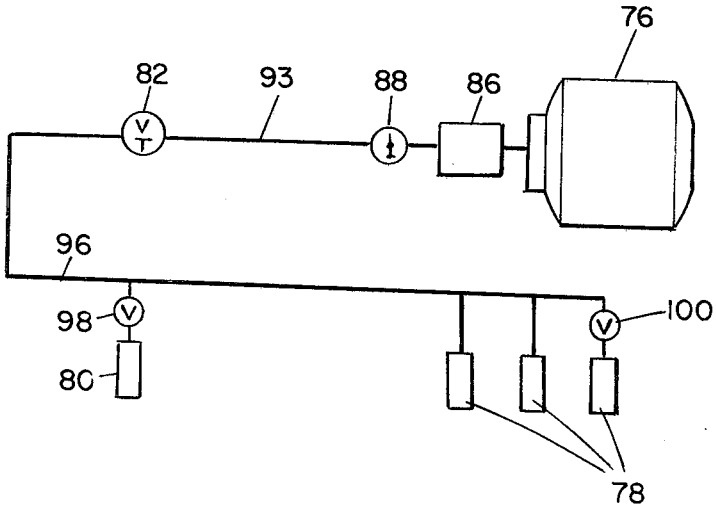
FIG. 6 is a diagram showing the gas supply system of the machine illustrated in FIG. 1.

The heating system is diagramatically illustrated in FIG. 6 with the reference numerals on the diagram correlating to the physical structure shown in FIGS. 1 and 2. The diagram has been simplified. The gas supply tank 76 provides fuel to the line 93 through the pressure regulator 86 and gauge 88. This fuel supply is controlled by the main control or throttle valve 82. The valve 82 may be a valve which can be adjusted to provide an initial flow of gas suitable as a pilot light for the burners 78 and 80 with control of the lever 84 then providing the main fuel flow for the heating means, that is the jets or burners 78 and 80. From the throttle valve 82 the fuel is fed through a line 96 (a composite depiction of the other fuel lines) to the jet 80 through a manually controlled valve 98 and to the jets or burners 78. One of the jets 78 is depicted with a manually controlled valve 100 in series therewith. Although one jet or burner 78 may be employed, a second or even third burner 78 may be provided with a valve in series therewith. This permits combustion or flame from one or two burners 78 with the third burner 78 having the valve 100 being selectively operable by the operator to provide additional heat if required depending on ambient conditions. Similarly with respect to the burner 80, the valve 98 in series therewith permits selective use of the rear burner 80 as required by the operator depending on conditions. With this connection, if all burners are to be utilized, the valves 98 and 100 may be opened to a desired preset position (which may be maximum), and with the control valve 82 providing an initial flow of gas suitable for a pilot light, all burners 78 and 80 would have a pilot flame. The control lever 84 which controls the flow of fuel through the valve 82 can then be operated by the operator to produce the desired flame from the heating jets or burners. Other well known fuel connections and fuel components may be used for the heating system in accordance with the invention.

Figure 5:
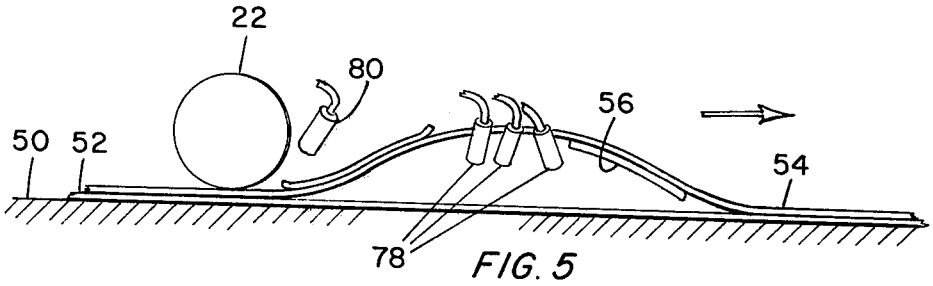
FIG. 5 is a diagrammatical side view illustrating the operation of the machine of this invention.

Referring now to FIG. 5, there is diagramatically illustrated the major operating components of the machine 10 and the physical relation between those components and the layers 52 and 54 of roofing material. As the machine 10 is advanced or moved by the operator in the direction of the arrow (that is to the right), the leading or underlying guide shoe 56 which has previously been interposed between the edge of the upper layer 54 and lower layer of roofing material 52 gradually separates or elevates the upper layer of roofing material 54 to expose to the first heating means the adjacent facing surfaces of polyethylene film. The heating means or burners 78 have the flame therefrom controlled by the operator to break apart the polyethylene film with the proper application of the flame being directed to the facing exposed layers of bitumen until it is plastic enough to flow under pressure. As the machine 10 advances, the trailing or overlying guide shoe 58 gradually guides and urges the upper layer of roofing material 54 into contact with the lower layer 52 with the roller member 22 behind the trailing edge of the shoe 58 applying pressure to promote uniform flow of the facing surfaces of now plastic bitumen. If the ambient temperature is low, the operator may optionally ignite the second heating means or burner 80. The orientation of the burner 80 is to apply flame or heat to the trailing edge of the shoe 58 as well as to the adjacent surface of the roller member 22 as well as to the upper surface of the layer or strip of roofing material 54. For thermal conductivity, as well as to prevent distortion upon application of heat, the guide shoes 56 and 58 are formed from a heat treated material such as heat treated steel. The roller member 22 in the preferred embodiment is made of solid aluminum which, during experimentation, appeared to have the proper thermal conductivity as well as weight to provide optimum results for the particular configuration of machine 10 as illustrated.

By reference to FIGS. 1 and 2, the positioning and operation of the machine 10 will be described. As previously described, a first layer of roofing material 52 is suitably bonded to the roofing surface 50 such as by means of a liquid adhesive. A second layer or strip of roofing material 54 is positioned on the roof 50 with the edge thereof overlapping the edge 74 of the adjacent strip of roofing material 52. The machine 10 is then positioned appropriately by lifting the edge of the upper layer 54 and positioning the underlying or lead guide shoe 56 therebeneath. The valving means such as main control valve 82 is then suitably initially adjusted to provide a pilot ignition flow of fuel to the main heating means or front burners 78 (as well as the rear burner 80 if desired). As can be seen in FIG. 2, in the initial or operating position, the wheel 26 is alongside, but not in contact with, the edge of the upper strip of roofing material 54; the lead guide shoe 56 extends beneath the edge of the strip of roofing material 54 a distance approximately equal to the distance of the overlapping edge; the trailing guide shoe 58 has the lower surface thereof abutting the upper surface of the material 54 a width sufficient to extend beyond both sides of the overlapping region; and the roller member 22 is initially positioned on the overlapping region and has a width at least sufficient to extend to both sides of the overlapping area. The operator then grasps the outer ends of handle 18 and pulls back or pivots the control lever 84 to provide maximum fuel flow to the front burners 78 (and rear burner 80 if desired). For a short initial interval of time, the operator does not move the machine 10 but permits it to remain there until the facing surfaces of polyethylene film are broken and drawn apart and the thus exposed bitumen heated to a plastic state. The operator then pushes the machine 10 to the right as illustrated in FIGS. 1 and 2 in a uniform manner while visually observing the flow of bitumen out from the overlapping region to determine the proper adhesion. With correct movement, the flow of bitumen can be controlled to the edge of the upper strip of roofing material with no flow beyond the edge to provide proper consistency of the thus plasticized material. Furthermore, with proper speed and heat, the upper layer or strip of roofing material 54 will have very little if any puckering or deformation at the overlapping edge region.

For the particular roofing material having an illuminized upper surface 70, and with the selection of aluminum as the material for the roller member 22, the roller member 22 has practically no plastic bitumen adhering to the surface thereof thus providing high quality application of this particular roofing material with a minimum of manpower utilizing the machine 10. By visual observation of the flow of material out from the overlapping edge region the operator can suitably adjust the speed of movement of the machine 10 to provide the optimum results. If the material flowing from the edge is irregular and molten, the operator can either increase the speed of movement or decrease the amount of heat supplied. Conversely, if the bitumen material is not adhering correctly, the operator can slow down the speed of movement of the machine 10 or increase the amount of heat. If a puckering of the upper strip of roofing material 54 is observed, the operator may adjust the height of the front end of the machine 10 by manipulation of the adjusting arm 38 to lower or raise the lead guide shoe 56 according to the position of the wheel 26. The shape and dimensions of lead guide shoe 56 and trailing guide shoe 58 are selected to provide the minimum amount of separation between the adjacent strips of roofing material sufficient to allow positioning of the burners or jets 78 for providing the flame or heat in the separated region without major distortion of the upper layer of roofing material 54 during operation. Similarly, the overall length of the machine 10 and the length of the shoes 56 and 58 have been selected for this purpose.

While a preferred embodiment has been illustrated, it is to be understood that the frame may be composed of tubular material, other materials may be selected for the roller member 22, other heating means may be employed, and the location of the valves and controls may be suitably altered. For example, valves for controlling optional burners or jets may be positioned in proximate relation to the handle 18 for ready access by the operator. While there has been shown and described a preferred embodiment, it is to be understood that various other adaptations and modifications may be made within the spirit and scope of the invention.

What is claimed is:

1. A machine for joining sheets of roofing material in overlapping relation comprising:

frame means;

first guide shoe means adjacent the front end of said frame means and depending therefrom, said first guide shoe means being contoured and configured for positioning between the sheets and for raising the upper one of said sheets;

gas burner means on said frame means in depending relation thereto and arranged for directing flame between the thus-separated sheets of roofing material rearwardly of said first guide shoe means;

second guide shoe means contoured and configured for positioning over the upper sheet and for urging the upper sheet against the lower sheet after the flame has been applied, said second guide shoe means being in depending relation with said frame means rearwardly of said gas burner means;

roller means rotatably mounted on said frame means adjacent the rear end thereof for applying pressure to the thus-joined sheets; and means for supporting said front end of said frame means in spaced relation to said roofing material and for permitting movement of said machine while joining the sheets.

2. The combination according to claim 1 further including other gas burner means on said frame means rearwardly of said second guide shoe means for directing flame toward the upper surface of the upper sheet.

3. The combination according to claim 1 wherein said first guide shoe means is contoured upwardly from the front end thereof rearwardly and said second guide shoe means is contoured downwardly from the front end thereof.

4. The combination according to claim 1 wherein said machine further includes handle means secured to said frame means for operator movement of said machine and said machine further includes means mounted on said frame means for supplying gas to said gas burner means.

5. The combination according to claim 1 wherein said frame means includes handle means coupled to said rear end for enabling movement of said machine by an operator and said means for supporting said front end include a wheel.

6. The combination according to claim 5 wherein said machine further includes means for adjusting the height of said front wheel.

7. A machine for joining adjacent layers of roofing material comprising a frame, a wheel connected to the front of the frame, a front shoe connected to depend from the frame and adapted to fit and separate overlapping sheets of roofing material, a gas burner means depending from the frame for directing flame between separated sheets of roofing material rearwardly of said front shoe, means for supplying gas to said gas burner means, a rear shoe connected to depend from the frame rearwardly of said gas burner means and press separated sheets of roofing material together, and a roller mounted to the rear of the frame.

8. A roofing machine as claimed in claim 7 further comprising means for adjusting the height of the front wheel, and means for varying the supply of gas to said gas burner means.

9. A roofing machine as claimed in claim 7 further comprising a second gas burner means, and means for connecting the second gas burner means to the means for supplying gas.

* * * * *